United States Patent [19]

Ohtani et al.

[11] Patent Number: 4,861,693

[45] Date of Patent: Aug. 29, 1989

[54] CARRIER FOR ELECTROPHOTOGRAPHY

[75] Inventors: Junji Ohtani; Junji Machida; Eiichi Sano; Fumio Masuda, all of Osaka, Japan

[73] Assignee: Minolta Camera Kabushiki Kaisha, Osaka, Japan

[21] Appl. No.: 157,973

[22] Filed: Feb. 19, 1988

[30] Foreign Application Priority Data

Feb. 20, 1987 [JP] Japan ..... 62-38621

[51] Int. Cl.[4] ..... G03G 9/10

[52] U.S. Cl. ..... 430/106.6; 430/108; 524/904; 525/930

[58] Field of Search ..... 430/106.6, 108; 525/930; 524/904

[56] References Cited

U.S. PATENT DOCUMENTS

| | | | |
|---|---|---|---|
| Re. 31,072 | 11/1982 | Jadwin et al. . | |
| 3,533,835 | 10/1970 | Hagenbach et al. . | |
| 3,669,885 | 6/1972 | Wright et al. . | |
| 3,720,617 | 3/1973 | Chatterji et al. . | |
| 3,795,618 | 3/1974 | Kasper | 430/108 |
| 3,840,464 | 10/1974 | Van Engeland et al. . | |
| 3,873,356 | 3/1975 | Queener et al. . | |
| 3,898,170 | 8/1975 | Kasper | 430/108 |
| 3,916,065 | 10/1975 | Moriconi et al. . | |
| 4,013,573 | 3/1977 | Leikhim et al. . | |
| 4,062,693 | 12/1977 | Berger . | |
| 4,493,855 | 1/1985 | Sachdev et al. . | |
| 4,517,268 | 5/1985 | Gruber et al. . | |
| 4,518,673 | 5/1985 | Noguchi et al. . | |
| 4,555,466 | 11/1985 | Okada et al. . | |
| 4,600,675 | 7/1986 | Iwasa et al. . | |
| 4,609,603 | 9/1986 | Knapp et al. . | |
| 4,672,016 | 6/1987 | Isoda et al. . | |

FOREIGN PATENT DOCUMENTS

| | | | |
|---|---|---|---|
| 57-190957 | 10/1971 | Japan . | |
| 59-37553 | 12/1972 | Japan . | |
| 57-122449 | 9/1974 | Japan . | |
| 60-147750 | 5/1978 | Japan . | |
| 60-50543 | 5/1982 | Japan . | |
| 59-200262 | 7/1983 | Japan . | |
| 59-69762 | 4/1984 | Japan | 430/106.6 |
| 60-107038 | 6/1985 | Japan | 430/106.6 |
| 59-201064 | 10/1986 | Japan . | |
| 59-223458 | 3/1987 | Japan . | |
| 60-170865 | 6/1987 | Japan . | |

OTHER PUBLICATIONS

F. Lions, K. V. Martin, Journal of the American Chemical Society, 1957, 79, 2733–2738.

Solid State Communications, 45, 99(1983) (partial translation).

*Primary Examiner*—Paul R. Michl

*Assistant Examiner*—Jeffrey A. Lindeman

*Attorney, Agent, or Firm*—Burns, Doane, Swecker & Mathis

[57] ABSTRACT

This invention relates to carriers for electrophotography comprising a binder component including a binder resin, a polymeric-magnetic coordination complex, and an inorganic magnetic material dispersed in the binder component at the ratio of 100–900 parts by weight to 100 parts by weight of the binder component, which effect the electrical resistance as well as magnetic properties. Carriers of the invention are suitable, in particular, for a copier furnished with a high rotation developing sleeve.

1 Claim, No Drawings

CARRIER FOR ELECTROPHOTOGRAPHY

BACKGROUND OF THE INVENTION

This invention relates to carriers for electrophotography, more particulaly, carriers with high electrical resistance used in a developer applied to an electrophotographic copier or a printer.

A method of copying by an electrophotographic copier or a printer consists of six processes. These processes include a uniformly charging process of a photosensitive member surface, an electrostatic latent image-forming process by irradiation of light corresponding to images of a manuscript, a developing process of electrostatic latent images on the photosensitive member by toners contained in a developer, a transferring process of toners on the photosensitive member to a copying thing, such as a paper, a fixing process of toners to the copying thing, and a cleaning process of the photosensitive member.

Known developers used in, for example, electrophotographic copiers include a two-component developer mainly containing insulating non-magnetic toners and magnetic carriers, and an one-component developer mainly containing insulating magnetic toners constituted of magnetic materials. The two-component developer is used in the following developing system. Charges are generated by friction between toners and carriers such as iron particles, magnetic brushes of the carriers are formed on a surface of a developing sleeve with built-in magnets to stir and transport the toners to a developing region, and then the charged toners are contacted with oppositely charged electrostatic latent images formed on a surface of a photosensitive member to develop the toners.

A developing system using a two-component developer brings about a defect such as white lines in developed images because of a hard ear of brush on account of strong suction force between each carrier particle on a surface of a developing sleeve. When the content of toners in a developer decreases, other troubles occur such as the disorder of electrosttic latent images, the deficit of developed images and the adherence of carriers to a part of electrostatic latent images on a photosensitive member and the like, because the charges of the electrostatic latent images on the photosensitive member tend to run away through the low specific resistant carriers of $10^6$ Ω.cm or less, or charges are injected from the developing sleeve to the carriers.

In order to overcome the aforementioned problems relating to carriers consisting of magnetic materials such as iron particles, binder-type carriers have been proposed, in which magnetic particles with small particle size are blended with insulating binder resin.

Further, development at high speed, being desired recently, has brought a following new problem. Both a sleeve and magnets built in the sleeve are required to rotate at a high-speed in order to prevent irregular developments when binder-type carriers are used for the high-speed development. The high-speed rotation of magnets causes the increase of temperature of a sleeve on account of excessive eddycurrent.

Therefore, it has been proposed that binder-type carriers filled with a high content of magnetic particles are used in a copying machine assembled so that only the sleeve can rotate and the magnets built in the sleeve are fixed. Such carriers, however, have not enough magnetic properties to result in adherence of the carriers to a non-image part on the surface of an electrostatic latent image carrier. It is not preferred from the viewpoint of the retention of electrical resistance of carriers that the content of the magnetic particles in carriers becomes very high.

SUMMARY OF THE INVENTION

The object of the invention is to provide carriers having enough magnetic properties as well as high electrical resistance.

This invention relates to binder-type carriers for electrophotography comprising a polymeric coordination complex.

DETAILED DESCRIPTION OF THE INVENTION

Binder-type carriers containing magnetic particles in binder resin at a high content have not yet enough electrical resistance and magnetic properties. The magnetic particles can not be dispersed uniformly as primary particles in the resin on account of the high content of the magnetic materials, which results in problems such as high specific grvity and fragility.

This invention overcomes the above mentioned problems and provides carriers having sufficient magnetic properties, even at a lower content of inorganic magnetic materials, as providing well as high electrical resistance.

The object is achieved by binder-type carriers for electrophotography comprising a polymeric-magnetic coordination complex.

Carriers of the invention are suitable for a copier furnished with a high rotation developing sleeve. The carriers do not adhere to a photosensitive member and do not develop to a part of images, and can form good images without the deficits of images and the carrier fogs. The life of a photosensitive member and carriers are extended due to the lack of carrier development and the decreased consumption of the carriers. Clear color images not only with color tones but also without muddiness are obtained because carriers are not transferred to the images.

A polymeric-magnetic coordination complex of the invention is a polymeric coordination complex having ferromagnetic properties.

An illustrative example of such a polymeric-magnetic coordination comples is PPH-$FeSO_4$ (simplified form of polybis(2,6-pyridinediyl methylidene nitrilohexamethylene nitrilomethylidene iron sulfate), (referred to as F. Lions and K. V. Martin: J. Am. Chem. Soc., 79, 2733(1957) and T. Sugano, M. Kinosita, I. Shirotani and K. Ohno: Solid State Comm., 45, 99(1983)), which is a polymer-magnetic compound.

The polymeric-magnetic coordination complex of PPH-$FeSO_4$ was synthesized as follows; 2,6-Dialdehydepyridine and 1,6-hexadiamine of an equal mole to 2,6-dialdehydepyridine were dehydrated and condensed at 60° C. in hot ethanol to obtain a ligand, $(C_{13}H_{17}N_3)_n$, (which is a white powder, about 140° C. of $T_m$, and simply called PPH hereinafter), and then, the PPH was reacted with $FeSO_4.7H_2O$ in hot water at 80°-90° C,. under nitrogen current to obtain dark red solids. The resultant materials were dried in a vacuum desiccator for 72 hours to obtain a desired polymeric-magnetic coordination complex. The identification was made by an elemental analysis and a far infrared absorption spectrum.

| | elemental analysis | | |
|---|---|---|---|
| | C | N | Fe |
| calcd. | 45.21 | 12.17 | 8.09 |
| found | 43.95 | 12.05 | 7.98 |

The elemental analysis was calculated from the empirical formula of $((Fe(C_{13}H_{17}N_3)_2)SO_4.6H_2O))_n$. As the molecular weight of PPH-$FeSO_4$ is 689.9n, the content of each element(%) is calculated from the following formula:

$$Calc.(\%)=(A)\times(N)/(689.9)\times 100$$

wherein A represents the atomic weight of an element and N represents the number of the element per one molecule of PPH-$FeSO_4$.

The material has 42 G of Magnetic flux density(Bm), 3.5 emu/g of magnetization amount(o), 7.1 G of remanent magnetism(Hc) under 1000Oe of applied magnetic field.

Examples of the binder resin applicable in carriers of the invention are: the acrylic resin containing a polar group such as a carboxyl group, hydroxyl group, glycidyl group, amino group and the like; for example, a copolymer of a monomer such as methacrylic acid, acrylic acid, maleic acid, itaconic acid, etc., a hydroxyl-containing monomer such as hydroxyl-polypropylene-monomethacrylate, polyethylene glycol-monomethacrylate, etc., an amino group-containing monomer such as dimethylaminoethyl methacrylate, etc., or glycidyl methacrylate and the like with lower alkyl acrylate and/or styrene; polyester resin, for example, a condensate of polyol such as ethylene glycol, triethylene glycol, 1,2-propylene glycol, 1,4-butanediol, etc., with dicarboxylic acid such as maleic acid, itaconic acid, malonic acid, etc.; and thermoplastics such as epoxy resin, etc.; a mixture of the above resin. Each resin may be crosslinked three dimensionally inorder to adjust the viscosity.

The above mentioned binder resins are mixed at the ratio of 0–99% by weight on the basis of the total amount of carriers.

Magnetic carriers of a binder-type of the invention are further mixed with inorganic magnetic particles. Any inorganic magnetic particles can be used in the invention so far as they have specific volume resistance of more than $10^5$ Ω.cm. In particular, ferrite is preferred.

Concrete examples of ferrite, which are shown in U.S. Pat. No. 4,473,483, have the general formula;

$$M_{\frac{1-x}{1+x}(1-y)}Fe_{\frac{2x}{1+x}(1-y)}O_y$$

wherein M is an atom selected from the group consisting of Mn, Ni, Co, Mg, Cu, Zn and Cd; x is within the range of between 0.5 and 1.0 and y is within the range of between 0.1 and 0.571.

Ferrite of the invention in addition of the above ferrite includes metals containing ferromagnetic metals such as magnetite shown by $FeO.Fe_2O_3$, iron, Nickel and Cobalt, etc., alloys of the metals and compounds thereof.

The inorganic magnetic materials are mixed with a binder component including the binder resin and the polymeric-magnetic coordination complex at the ratio of 100–900 parts by weight, preferably, 200–800 parts by weight to 100 parts by weight of the binder components.

Sufficient magnetization cannot be achieved if the inorganic magnetic particles are less than 100 parts by weight, and carriers are fragile and the electrical resistance decreases on account of the non-uniform dispersion of magnetic particles (secondary particles) in the resin if the inorganic magnetic particles are more than 900 parts by weight.

Carriers of the invention may be mixed with a dispersant, such as carbon black, colloidal silica, colloidal titanium, colloidal alumina, which are preferably contained at 0.01–3% by weight in carriers.

Binder-type carriers using the above mentioned materials are prepared by, for example, mixing the materials sufficiently with a mixer etc. and then grinding them, followed by fusing and kneading them with a extrusion kneader. The kneaded materials thus obtained are cooled, ground finely and classified to obtain magnetic carriers having prescribed particle sizes.

According to the present invention, carriers have high electrical resistance as well as high magnetic properties.

EXAMPLE

This invention is exemplified in detail by examples, compartive examples, and productive examples.

Electrical resistance of carrier particles in the examples and the comparative examples were measured as follows.

A sample of 1 mm in thickness and 50 mm in diameter was put on a round of electrode made of metal and then an electrode of 875.4 g in weight and 20 mm in diameter and a guarded electrode of 38 mm in internal diameter and 42 mm in external diameter were put on the sample to be supplied with 500 V of direct voltage. The value of resistance was read after 1 minute to calculate the specific volume resistance of the sample. The environment of the measurement was 25±1° C. of temperature and 55±5% of relative humidity and the measurement was repeated five times to obtain the mean value.

PREPARATION EXAMPLE 1 OF TONER (−) chargeable toners (toner A)

| | parts by weight |
|---|---|
| polyester resin (130° C. of softening temperature, 60° C. of glass transition temperature) | 100 |
| carbon black (MA #8 produced by Mitsubishi Kasei Co.) | 50 |

The above materials were mixed sufficiently with ball mills and then kneaded on three rolls heated at 140° C. The kneaded materials were allowed to cool, ground roughly with a feather mill, ground finely with a jet mill, and then air-classified to obtain fine particles of 13 μm in mean particle size (toner A).

PREPARATION EXAMPLE 2 OF TONER (+) chargeable toners (toner B)

Toner B was prepared similarly as Preparation Example 1 of toner except that the following compositions were used.

| | parts by weight |
|---|---|
| styrene- n-butylmethacrylate resin (132° C. of softening temperature; 60° C. of glass transition temperature) | 100 |
| Carbon black (MA #8 produced by Mitsubishi Kasei Co.) | 5 |
| nigrosine dye (Bontron N-01 produced by Orient Chemical Co.) | 3 |
| EXAMPLE 1 | |
| polyester resin (123° C. of softening temperature, 65° C. of glass transition temperature) | 75 |
| inorganic magnetic particles (EPT-1000, made by Toda Kogyo Co.) | 400 |
| carbon black (MA #8 produced by Mitsubishi Kasei Co.) | 2 |
| Polymeric-magnetic Coordination complex particles PPH-$FeSO_4$ | |

The above mentioned materials were mixed and ground sufficiently with Henschel mixer, and then fused and kneaded with an extrusion kneader (the temperature of the cylinder was 160° C. and that of the cylinder head was 150° C.). The kneaded materials thus obtained were cooled, ground finely and classified to obtain magnetic carriers having 55 μm in mean particle size.

The resultant carriers had the specific volume resistance of $7.08\times10^{13}$ Ω.cm.

The carriers had 1082 G of magnetic flux density(Bm), 45.6 emu/g of magnetization amount(σ), 217.6 G of remanent magnetism(Hc) under 1000 Oe of applied magnetic field.

(i) A developer was prepared by mixing Toner A with the carriers at the ratio of 10 wt.% of Toner A. The charge amount of the toner after mixing for 10 minutes was −11.6 μC/g.

The charge amount of the toner was −19.9 μC/g after the developer was kept under the temperature of 30° C. and the high humidity of 85% RH for 24 hours.

The developer was put to use to develop positively-charged electrostatic latent images according to the magnetic brush developing method with the developing machine equipped with a (+) chargeable Se-type photosensitive member and a heat-fixing roll coated with teflon (registered trade mark). The development was continuously repeated 60000 times.

The image quality was excellent and had no carrier fogs after the copying resistant test of 60,000 times as well as at the initial stage of the test. No carriers were seen adhered to the photosensitive members.

(ii) A developer was prepared similarly as (i) using Toner B of Preparation Example 2, and evaluated similarly as (i) to obtain the following results; The charge amount of the toner after mixed for 10 minutes was +12.4 μC/g. The charge amount of the toner was +12.1 μC/g after the developer was kept under the temperature of 30° C. and the high humidity of 85%RH for 24 hours.

Even after the same copying resistance test as (i), the image quality was excellent and had no carrier fogs as well as at the initial stage of the test. But, in this case the copying resistance test was carried out by developing negatively-charged electrostatic latent images with a (−) chargeable laminated organic photosensitive member.

EXAMPLE 2

Carriers were prepared similarly as EXAMPLE 1 except that 400 parts by weight of the magnetic particles, 90 parts by weight of the polymeric-magnetic coordination complex and 10 parts by weight of the resin were used.

The obtaned carriers had the specific volume resistance of $1.26\times10^{14}$ Ω.cm.

The carriers had 1257 G of magnetic flux density(Bm), 61.5 emu/g of magnetization amount(σ), 246.2 G of remanent magnetism(Hc) under 1000 Oe of applied magnetic field.

The two kinds of developers were prepared similarly as EXAMPLE 1 (i) and (ii) using toner A and toner B. The charge amounts of the toners were −12.5 μC/g and +13.0 μC/g respectively. After the developers were kept under the temperature of 30° C. and the high humidity of 85%RH for 24 hours, the charge amounts of the toner were −11.1 μC/g, and +12.6 μC/g respectively.

Each developer was put to the copying resistance test similarly as EXAMPLE 1. After the copying resistance test, the image quality was respectively excellent and had no development and no adherence of carriers as well as at the initial stage of the test. The surface of the photosensitive member was good.

COMPARATIVE EXAMPLE 1

Carriers were prepared similarly as example 1 except that a polymeric-magnetic coordination complex was not used. The obtained carriers had the spcific volume resistance of $5.62\times10^{11}$ Ω.cm. The carriers had 1032 G of magnetic flux density(Bm), 43.5 emu/g of magnetization amount(σ), 213 G of remanent magnetism(Hc) under 1000 Oe of applied magnetic field.

The specific volume resistance and the magnetic properties of the carriers were much worse than the carriers of Examples 1 and 2 although the same parts by weight of the magnetic carriers were used. Accordingly, it is understood that the polymeric-magnetic coordination complex affects the maintenance (or improvement) of electrical resistance and magnetic properties.

(i) A developer was prepared by mixing Toner A with the carriers at the ratio of 10 wt.% of Toner A. The charge amount of the toner after mixing for 10 minutes was −12.0 μC/g, the value of which was almost the same as those of the Examples (−11.6 μC/g, −12.5 μC/g). Accordingly, it is understood that the compounding of the polymeric-magnetic coordination into carriers does not impair static properties.

Copies were made with the same copying machine as Example 1. The image quality was not good because of the developments of carriers onto a substrate and the fogs of carriers at the edges as predicted from the value of electrical resistance.

(ii) A developer was prepared with toner B similarly as (i). The charge amount of the toner after mixing for 10 minutes was +12.7 μC/g, the value of which was almost the same as those of the Examples (+12.4 μC/g, +13.0 μC/g). Copies were made with the same copying machine as Example 1. The image quality was not acceptable because of the fogs of carriers on both a substrate and at the edges as predicted from the value of electrical resistance.

If the specific volume resistance of the carriers is as low as $10^8$–$10^{12}$ Ω.cm, the specific volume resistance of the developers also decreases. In such case, the latter resistance can be made higher by increasing the content of the toner in the developer (generally 5 wt.% or more), but this manner is not preferred, because it does not give a suitable edge-effect and many carriers are inevitably adhered to images by injected charges when the content of toner in the developer decreases as the developing progresses.

What is claimed is:

1. A carrier for electrophotography comprising: a binder component which comprises a binder resin, a polymeric-magnetic coordination complex comprising polybis (2,6-pyridinediyl methylidene nitrilohexamethylene nitrilomethylidene) iron sulfate, the simplified formula thereof being PPH-$FeSO_4$, and an inorganic magnetic material dispersed in said binder component at a ratio of 100 to 900 parts by weight of said magnetic material to 100 parts by weight of said binder component.

* * * * *